US005314139A

United States Patent [19]

Mori

[11] Patent Number: 5,314,139

[45] Date of Patent: May 24, 1994

[54] TRANSFER TAIL HOLDING DEVICE

[75] Inventor: Kiyoaki Mori, Komatsu, Japan

[73] Assignee: Tsudakoma Kogyo Kabushiki Kaisha, Kanazawa, Japan

[21] Appl. No.: 947,137

[22] Filed: Sep. 18, 1992

[30] Foreign Application Priority Data

Sep. 20, 1991 [JP] Japan ..... 3-268585

[51] Int. Cl.[5] ..... B65H 49/12

[52] U.S. Cl. ..... 242/131; 139/450

[58] Field of Search ..... 242/131, 131.1, 130; 139/450

[56] References Cited

U.S. PATENT DOCUMENTS

| | | | |
|---|---|---|---|
| 1,578,488 | 3/1926 | Walker | 242/131 X |
| 2,332,889 | 10/1943 | Bouvet et al. | 242/131 |
| 2,588,053 | 3/1952 | Smith et al. | 242/131 |
| 4,358,068 | 11/1982 | Weiss | 242/131 |
| 4,658,866 | 4/1987 | Takegawa | 139/450 |
| 4,836,468 | 6/1989 | Singer | 242/131 |
| 4,887,649 | 12/1989 | van Mullekom | 139/450 |
| 5,143,125 | 9/1992 | Tamatani et al. | 139/450 |

FOREIGN PATENT DOCUMENTS

| | | |
|---|---|---|
| 0171057 | 11/1988 | European Pat. Off. . |
| 0306079A1 | 3/1989 | European Pat. Off. . |
| 0363909A2 | 4/1990 | European Pat. Off. . |
| 0365472A1 | 4/1990 | European Pat. Off. . |
| 63-227832 | 9/1988 | Japan . |

*Primary Examiner*—Stanley N. Gilreath
*Attorney, Agent, or Firm*—Klarquist Sparkman Campbell Leigh & Whinston

[57] ABSTRACT

A transfer tail holding device is provided to hold a transfer tail formed between one weft package and an other spare weft package. The holding device comprises a holding member having at least one notch for receiving the transfer tail. Therefore, it is possible to position the transfer tail for pick-up by another mechanism.

11 Claims, 7 Drawing Sheets

TRANSFER TAIL HOLDING DEVICE

BACKGROUND OF THE INVENTION

1. Field of the Invention:

This invention relates to a device for holding a transfer tail formed between one weft package and the other spare weft package which are held by weft feeding means arranged to feed weft to a weaving machine.

2. Description of the Prior Art:

One weft package held by weft feeding means sometimes cannot feed weft to a weaving machine due to, for example, an end breakage. In this case, the weft is led from the other spare weft packages connected through a transfer tail. Thus, a weft leading device mounted on the weaving machine is moved toward the transfer tail so that the transfer tail is picked up by the weft leading device at a predetermined position. Subsequently, a weft end extending from the one weft package is cut off, and a weft end extending from the other spare weft package is led from the weft leading device to the weaving machine. Thereafter, weft inserting is resumed.

In order to pick up the transfer tail by the weft leading device, the transfer tail is generally positioned at the picking-up position. The positioning is performed by holding each side of the transfer tail using a pair of clampers (see Japanese Patent Public Disclosure (KOKAI) No. 63-227832, U.S. Pat. No. 4,658,866 or EP171,057).

The clampers, however, are constructed to hold the weft between the clamper's disks, and are spring-loaded to maintain the weft. In the clampers, manual operation by an operator should be required for positioning the transfer tail.

SUMMARY OF THE INVENTION

It is an object of the present invention to enable a mechanical positioning of a transfer tail.

The present invention relates to a device for holding a transfer tail formed between one weft package and the other spare weft packages which are held by weft feeding means. The holding device comprises a holding member with at least one notch for receiving the transfer tail.

According to the present invention, since the transfer tail is received in the notch of the holding member, the transfer tail can be positioned at a position to be picked up by a weft leading device. Therefore, it is possible to perform a mechanical operation in which the notch receives the transfer tail without any manual operation by an operator, thereby positioning the transfer tail for pick-up in the notch by the weft leading device.

When the weft feeding means is provided with a body of revolution for rotatably holding the respective weft packages about one axis, and a post for supporting the body of revolution, the holding member can be mounted on the post to be pivotable in a vertical plane.

Alternatively, the holding member may be secured to the body of revolution.

Each notch may include a first notch portion having a large opening, and a second notch portion having a small opening which is continuous with the first notch portion.

Further, the holding member may be provided with a lever which is pivotable in the direction crossing a line passing through the notch. Otherwise, the holding member may include a main body, and a pivoting portion which is mounted on the main body to be pivotable about an axis in parallel with the line passing through the notch, and defines the notch together with the main body.

Moreover, a clipper may be provided to cut off the transfer tail extending through the notch.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
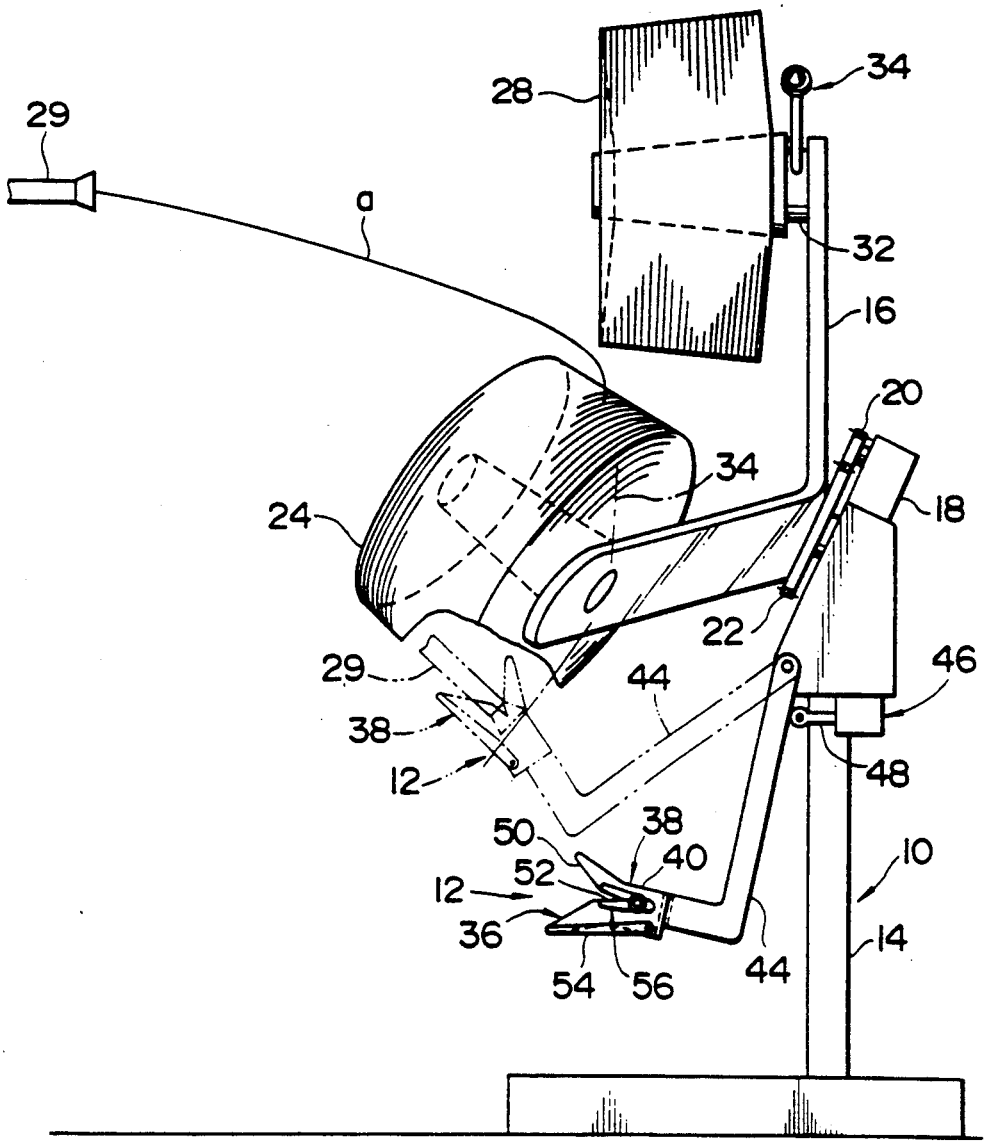
FIG. 1 is a side view of a holding device of the present invention, applied to one embodiment of a weft stand.
Figure 2:
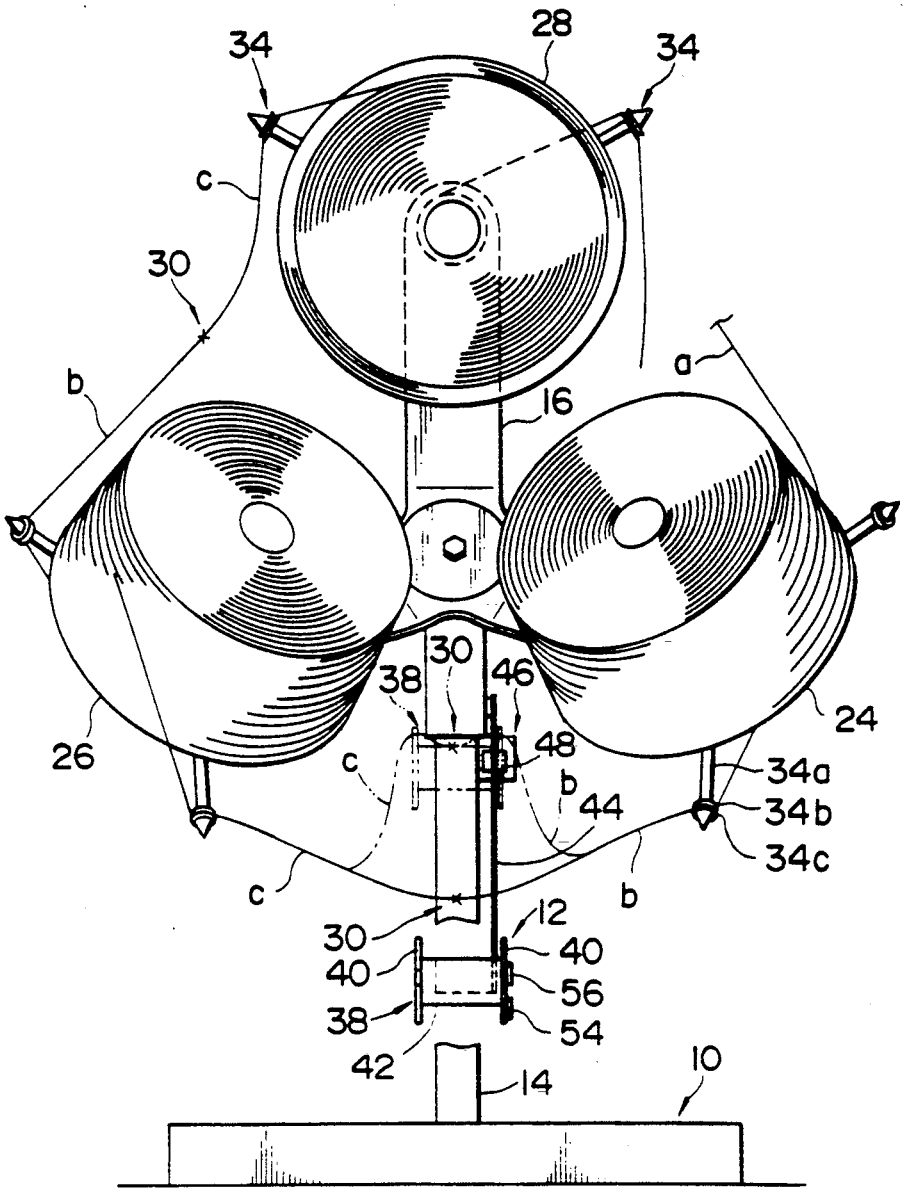
FIG. 2 is a front view of the holding device shown in FIG. 1.

Referring to FIGS. 1 and 2, there are shown weft feeding means including a weft stand 10 which is mounted in the vicinity of a weaving machine (not shown) to feed weft to the weaving machine, and a transfer tail holding device 12 of the present invention which is applied to the weft stand 10.

The weft stand 10 is provided with a post portion 14, and a body of revolution 16 which is supported by the post portion 14 and is rotatable about one axis.

The body of revolution 16 of the weft stand is actuated by a motor 18 mounted on a top portion of the post 14. The body of revolution 16 is rotated 120 degrees at a time counterclockwise about the one axis through a gear 20 secured to a rotary axis of the motor 18 and a gear 22 meshing with the gear 20 secured to the body of revolution 16.

Three weft packages 24, 26 and 28 are supported to the body of revolution 16 at three positions at interval of 120 degrees about the one axis, i.e., at a released position, a waiting position, and a supply position (only two weft packages 24 and 28 are shown in FIG. 1 for the sake of simplicity).

Weft a is fed from the weft package 24 in the released position, and extends to the weaving machine through a weft leading device (a suction pipe in FIG. 1) 29 while the device is not operated. Transfer tails 30 are respectively formed between the weft package 24 and the spare weft package 26 adjacent thereto and positioned at the waiting position, and between the spare weft package 26 and the other weft package 28 positioned at the supply position where the weft package 28 is carried on the weft stand 10.

It is assumed that two weft packages are respectively positioned at the waiting position and the supply position. A joint is then automatically or manually formed by joining the weft end extending from a core of the weft package in the waiting position, i.e., tail end b to the weft end extending from a surface of the weft package to the supply position, i.e., leading end c by using a knotter (not shown). The transfer tail 30 refers to the joint and a portion in the vicinity of the joint.

When the weft of the weft package 24 in the released position is consumed, the weft is subsequently led from the spare weft package 26 in the waiting position through the transfer tail 30 formed between the weft packages 24 and 26. Next, the body of revolution 16 is rotated in a counterclockwise direction by 120 degrees in FIG. 2 to move the weft package 26 to the released position.

As illustrated in the drawings, the tail end b and the leading end c are respectively releasably held, on the way, by each holding portion 34 of each supporting member 32 which is mounted on the body of revolution 16 to support the respective weft packages. The holding portion 34 includes a disk 34*b* secured to a supporting rod 34*a*, and a disk 34*c* slidably mounted on the supporting rod 34*a* and spring-loaded toward the disk 34*b*. Each weft end of each weft package is held between the disks 34*b* and 34*c*. The magnitude of the grip on the weft ends by the disks is set such that the weft end can be released from between the respective disks 34*b*, 34*c* when a predetermined magnitude of tensile force is applied to the weft end.

If a breakage accident of the weft a occurs in the weft package 24 during release of the weft, the suction pipe 29 is operated to move toward the transfer tail 30 and perform a suction operation to suck the transfer tail 30 from between the respective weft packages 24 and 26. The transfer tail 30 is held at a predetermined position by the holding device 12 of the present invention so that the transfer tail 30 can be surely sucked by the suction pipe 29.

The transfer tail holding device 12 is provided with a holding member 38 having a pair of parallel notches 36 for receiving the transfer tail 30. The holding member 38 includes a pair of side parallel plates 40, and a connection plate 42 for connecting the respective side plates 40 to be spaced from each other, the side plates 40 being secured to the respective ends of the connection plate 42. Each side plate 40 is provided with a substantially V-shaped notch 36.

The holding member 38 is attached to an arm member 44 composed of a L-shaped plate, which in turn is supported by the post 14. The arm member 44 is pivotally mounted on the post 14 at the distal end of the longitudinal section of the arm member 44, and is pivotable in a vertical plane. A back face (outer surface) of the connection plate 42 of the holding member 38 is secured to the distal end of the lateral section of the arm member 44. The distal end of the lateral section of the arm member 44 extends away from the post 14. When the arm member 44 is pivoted, the holding member 38 can be positioned at a predetermined position (shown by the imaginary line) between the weft package 24 in the released position and the spare weft package 26 in the waiting position. The holding member 38 is arranged to extend from the distal end of the lateral section of the arm member 44, the notches 36 opening in the side of the holding member opposite the side connecting to arm member 44. As a result, when the arm member 44 is upwardly pivoted, the notches 36 extend diagonally upwardly at the predetermined position.

A piston rod 48 of a jack 46 mounted on the post 14 horizontally extends toward and contacts the back of the longitudinal section of the arm member 44 near the arm member's pivoting end. The arm member 44 is pivoted by extending and retracting the piston rod 48.

The holding member 38 is ordinarily situated at a predetermined raised position between weft packages 24 and 26. However, when the body of revolution 16 is rotated to transfer new weft packages into the release and waiting positions, the arm member 44 and the attached holding member 38 temporarily pivots (via retraction of rod 48) to a lowered, refuge position to avoid a collision with the weft packages.

When the holding member 38 is pivoted from the refuge position to the raised predetermined position, the transfer tail 30 suspended between the respective weft packages 24 and 26, i.e., a portion of the transfer tail 30 suspended between the respective holding portions 34, 34 of both weft packages 24 and 26, is led into the respective V-shaped notches 36 as shown by the imaginary line in FIG. 2, and is suspended between the respective notches 36. Thus, the transfer tail 30 is held and positioned by the above mechanical means at a predetermined position, i.e., at a suction position to be sucked by the suction pipe 29.

When the suction pipe 29 is moved toward the suction position, the open end of the suction pipe 29 is positioned between the respective side plates 40 of the holding member 38. Accordingly, it is possible to suck the transfer tail 30 from between the side plates. After the transfer tail 30 is sucked, the transfer tail 30 is cut off near the weft package 24. The suction pipe 29 is moved back to the initial position while sucking the leading end c from the weft package 26. By the sucking of the leading end c during or after this backward movement, sufficient tensile force is applied to the leading end c to release that end from being held between the disks 34*b*, 34*c* of the adjacent holding portion 34.

The notch 36 may be formed as one V-shaped notch. Preferably, the notch 36 is composed of a V-shaped first notch portion 50 having a large opening angle and a V-shaped second notch portion 52 having a small opening angle and contiguous with the first notch portion 50 as shown in the drawings (see FIG. 3). The large opening angle of the first notch portion 50 allows to facilitate the initial picking-up of the transfer tail 30. The small opening angle of the second notch portion 52 serves to lead the picked-up transfer tail 30 into a precise position within the notch 36.

Figure 3:
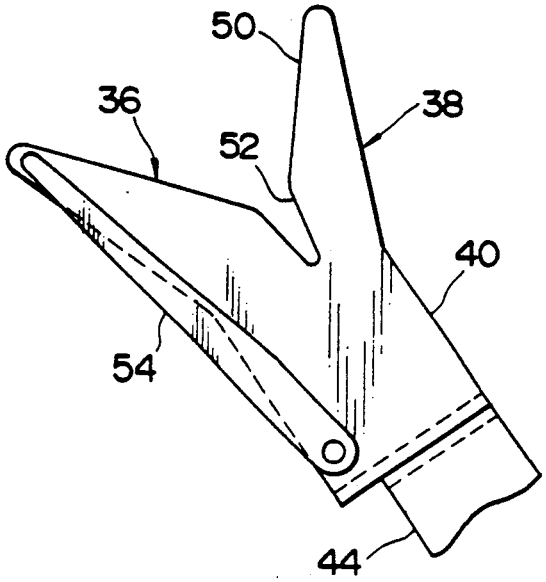
FIG. 3 is a side view of a holding member provided with a lever.
Figure 4:
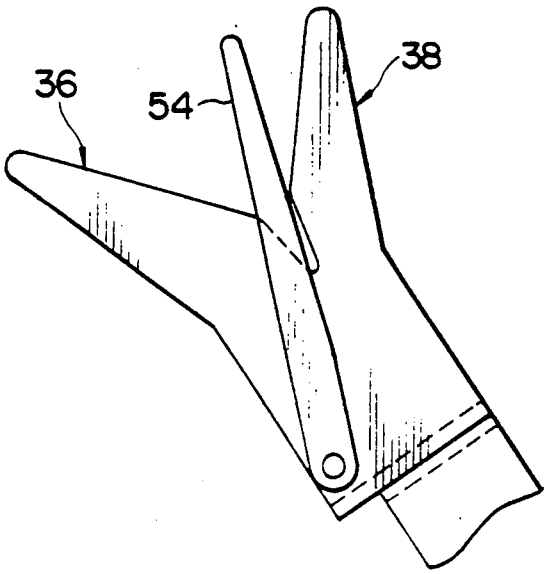
FIG. 4 is a side view of the holding member shown in FIG. 3 and illustrating a lever in a pivoted state.

The holding member 38 may include a lever 54 and/or a clipper 56. The lever 54 is pivotally mounted on an outer surface of one side plate 40 which faces the weft package 24 in the released position. In FIGS. 1 and 3 showing the enlarged lever 54, the lever 54 is arranged at a lower portion of the outer surface of the side plate 40. The lever 54 pivots from a position on plate 40 near the edge adjacent to the arm member 44. When the lever 54 is pivoted in a clockwise direction from the position as shown in FIGS. 1 and 3, a free end of the lever 54 crosses a line passing through the notch 36 as shown in FIG. 4.

The following describes the action of the lever 54: when the transfer tail 30 is received near the entrance of the notch 36 of the holding member 38, the lever 54 is pivoted so as to pass across the notch. In so pivoting, the lever 54 catches the transfer tail 30 and guides it further into the notch 36, where it can be securely held at a predetermined portion of the holding member 38.

Figure 5:
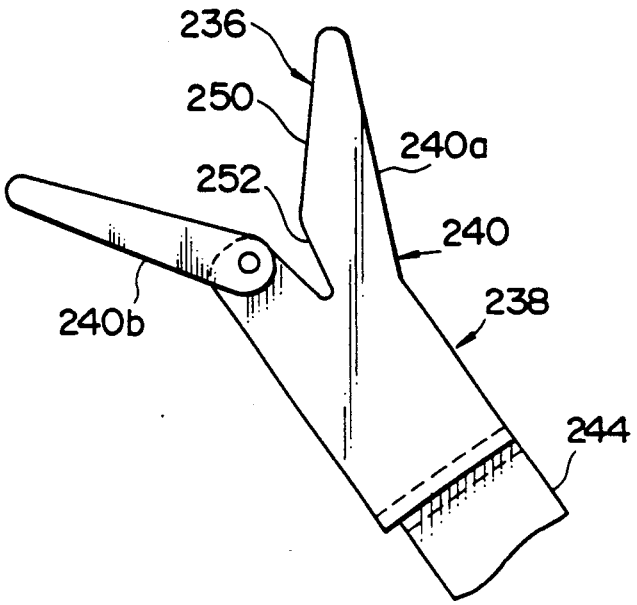
FIG. 5 is a side view of one embodiment of a holding member having a rockable portion to define a notch.
Figure 6:
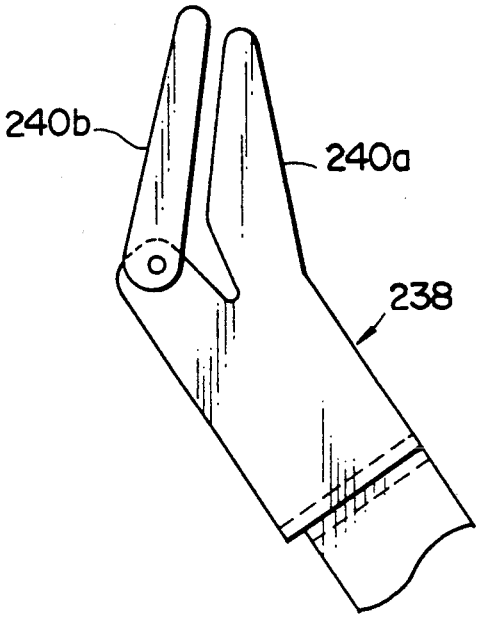
FIG. 6 is a side view of the holding member shown in FIG. 5 and illustrating the holding member in a partially rocked state.

As shown in FIGS. 5 and 6, instead of the lever 54, each side plate 240 may include a main body 240*a* and a pivoting portion 240*b* which is pivotably connected with the main body 240*a* about an axis extending perpendicularly between and through both side plates 240, and serves to define the notch 236 together with the main body 240*a*.

More specifically, the main body 240*a* serves to define one side of the V-shaped, first notch portion 250 and the second notch portion 252. The pivoting portion 240*b* serves to define the other side of the first notch portion 250. The pivoting portion 240*b* is pivoted in a clockwise direction from the position as shown in FIG. 5 to the position as shown in FIG. 6 to serve as the lever 54 of FIGS. 3, 4.

Figure 7:
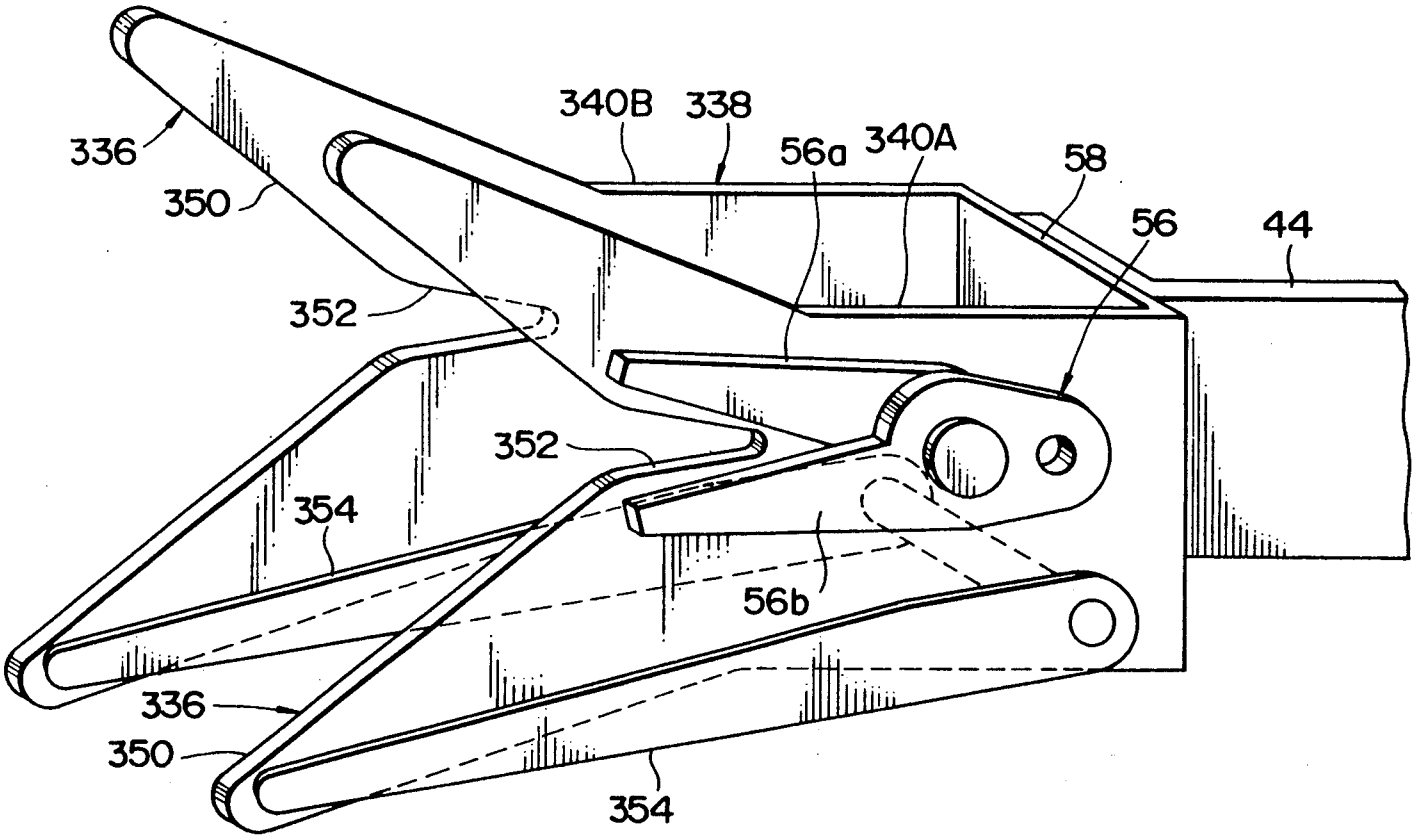
FIG. 7 is a perspective view illustrating another embodiment of the holding member.

The clipper 56 is provided with a pair of blades 56*a* and 56*b* as shown and enlarged in FIG. 7. The blades 56*a* and 56*b* are pivotably situated on the outer surface of the side plate 340A which faces the weft package 24 in the released position, and extend along the respective sides of the V-shaped second notch portion 352. One blade 56*a* is pivotably secured to the side plate 340A, and the other blade 56*b* is pivotably attached to blade 56*a*, so both blades are pivotable about an axis passing through a base portion of the blade 56*a*, the blade 56*b*, and the side plate 340A. Accordingly, the clipper 56 can cut off the transfer tail 40, which passes through the second notch portion 352, at the side of the weft package 24.

The other blade 56*b*, the lever 54 (see FIG. 3) and the pivoting portion 240*b* (see FIG. 5) can be respectively pivoted by using mechanical means (not shown) such as an air cylinder.

In FIGS. 1 and 2, the holding member 38 individually comprises a pair of side plates 40 and the connection plate 42, wherein the side plates 40 and the connection plate 42 are rigidly attached to each other. In another embodiment, such as shown in FIG. 7, the holding member 338 may be a U-shaped plate formed from a single piece of material, and may be provided with the same notch 336 as set forth above.

In this embodiment (FIG. 7), a pair of side plates 340A and 340B are respectively connected with both ends of the connection plate 58 at the side opposite to the opening end of the notch 336. When the transfer tail 30 passes through the respective notches 336, the connection plate 58 is partially opposed to the transfer tail 30 arranged between the respective notches 336. The end of the lateral section of arm member 44 is secured to the connection plate 58. Further, a pair of levers 354 are pivotably mounted on the respective side plates 340A and 340B.

Figure 8:
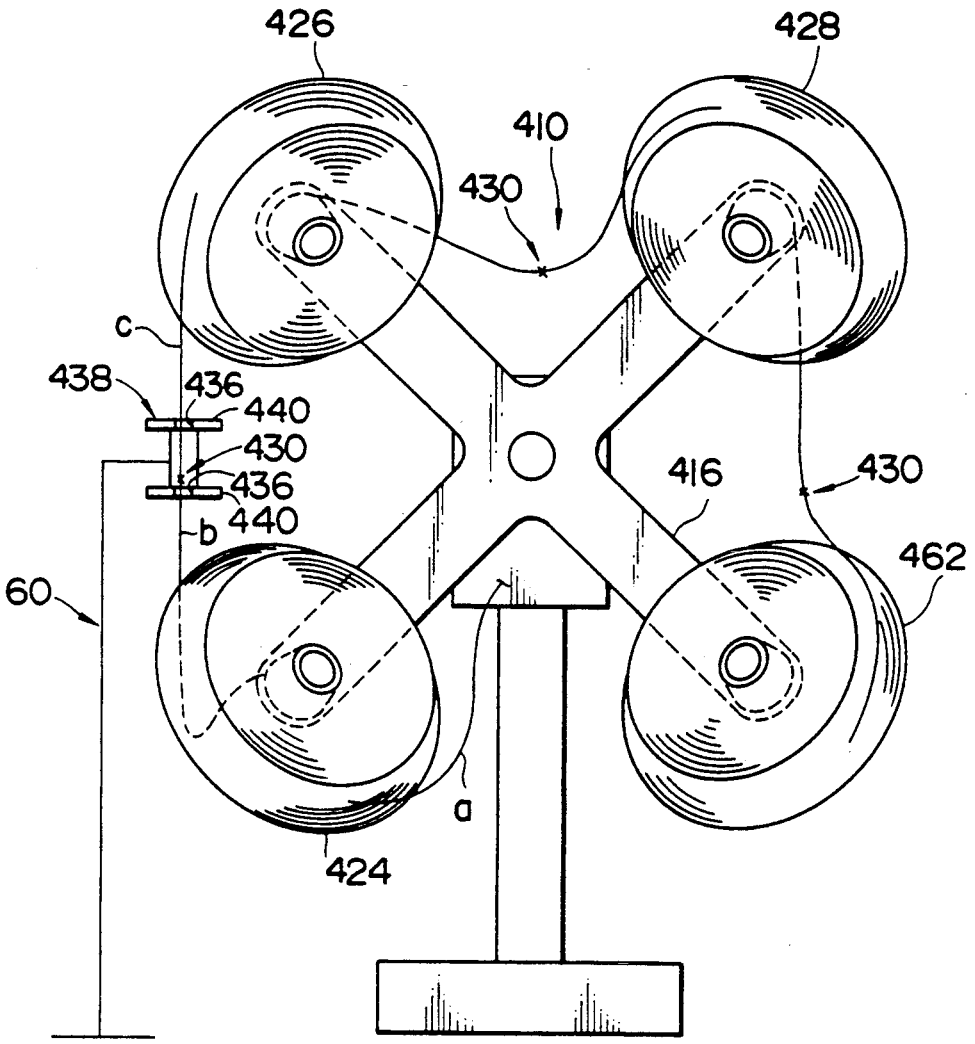
FIG. 8 is a front view of a holding device applied to another embodiment of the weft stand.

As shown in FIG. 8, the holding member 438 may be supported by holding member stand 60 in the vicinity of the weft stand 410. In the embodiment, the weft stand 410 is provided with a body of revolution 416 for supporting four weft packages at an angular interval of 90 degrees. The body of revolution 416 allows for the support of a first weft package 424 at a released position, a second weft package 426 at a first waiting position, a third weft package 428 at a second waiting position, and a fourth weft package 462 at a supply position, respectively. Additionally, the body of revolution 416 is rotatable to move the weft packages in a counterclockwise direction.

The first weft package 424 and the second weft package 426 are vertically arrayed, with a transfer tail 430 extending vertically between the two. In this embodiment, the holding member 438 is arranged so as to be movable perpendicular to the drawing, i.e., in the horizontal direction with the opening ends of the respective notches 436 directed toward the transfer tail 430. The transfer tail 430 is formed when a pair of weft packages are positioned at the second waiting position and the supply position, respectively.

Figure 9:
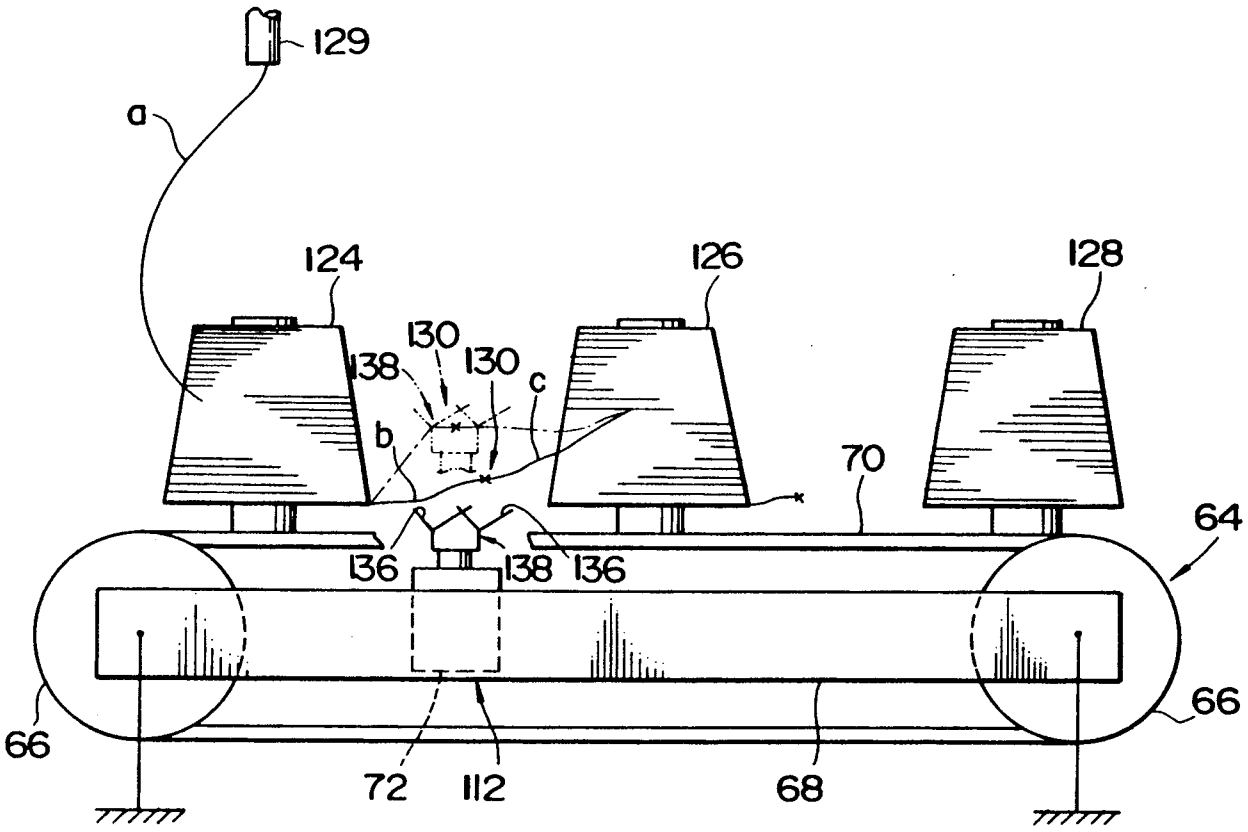
FIG. 9 is a general front view of a holding device applied to weft feeding means including a belt conveyor.

Referring to the embodiment of FIG. 9, the transfer tail holding device 112 of the present invention is applied to a weft feeding means comprising a conveyor belt 64.

The conveyor belt 64 is provided with a frame 68 for rotatably supporting a pair of pulleys 66, and an endless belt 70 surrounding the respective pulleys 66. Three spaced-apart weft packages 124, 126 and 128 are mounted on the belt 70.

When weft of the weft package 124 in the released position is consumed, or when an end breakage occurs in the weft package 124, the belt 70 is operated to advance the weft packages in a manner similar to that of the aforementioned body of revolution. Accordingly, the weft package 126 in the waiting position and the weft package 128 in the supply position are led to the released position and the waiting position, respectively.

The holding member 138 serving as a part of the holding device 112 is mounted on an air cylinder 72 which is secured to the frame 68 and extends and retracts vertically to move the holding member 138 up and down. When the air cylinder 72 is operated to raise the holding member 138, the holding member-138 is positioned such that the respective notches 136 receive the transfer tail 130 formed between the weft package 124 in the released position and the weft package 126 in the waiting position. Further, when the weft packages are advanced by the belt conveyor 64, the holding member 38 is temporarily lowered to a position to avoid collision with the moving weft package.

In this embodiment, the holding member 138 is moved up to a predetermined position where the transfer tail 130 is received by the respective notches 136 Thereafter, holding member 138 is elevated as set forth above such that the suction pipe 129 can suck the transfer tail 130.

In the above embodiments the holding member 38 has a pair of parallel notches 36 for receiving the transfer tail 30. Alternatively, there may be one notch 36 in place of a pair. In such a case, the suction position of the transfer tail should be close to the side plate 40.

Also, as in the embodiment shown in FIG. 7, if the clipper 56 is provided near the notch, it is possible to dispense with the notch 336 and substitute the clipper 56 therefor. In this case, it is suggested to fit the configuration of each blade 56*a*, 56*b* to that of the notch 336 and to provide no cutter blade at the front end.

What is claimed is:

1. A combination of a weft feeding means for successively moving weft packages from a spare weft package position to a first weft package position for feeding the weft, and a transfer tail holding device for holding a transfer tail formed between the weft packages respectively in the first weft package position and the spare weft package position, said transfer tail holding device comprising:

a holding member positionable adjacent to a first position between the weft packages in the first and spare weft package positions and having a notch for receiving said transfer tail, and a positioning means for selectively moving the holding member toward and away from the first position.

2. The combination according to claim 1, wherein said weft feeding means a includes body of revolution for rotatably holding the respective weft packages about one axis, and a post for supporting said body of revolution, said holding member being mounted on said post to be movable in a vertical plane.

3. The combination according to claim 1, wherein said notch is composed to a first notch portion and a second notch portion.

4. The combination according to claim 1, said holding device further comprising a lever which is mounted on said holding member, and is movable to cross through a line that extends through said notch.

5. The combination according to claim 1, said holding member is composed of a main body and a movable portion which is pivotably connected with said main body, said movable portion serving to define said notch together with said main body and to move to change the shape of said notch.

6. The combination according to claim 1, said holding device further comprising a clipper attached to the holding member for severing the weft that passes through the notch.

7. A transfer tail holding device for holding a transfer tail that extends between a first weft package and a spare weft package, the transfer tail holding device comprising:

a holding member having a notch for receiving and holding against movement in one direction a transfer tail formed between the first and spare weft packages, the notch defining an unobstructed path in a second direction to permit the tail to be freely moved away from the holding member, and a positioning means for moving the holding member into and out of a first position between the first weft package and the spare weft package for holding a transfer tail, the holding member moving relative to the first and spare weft packages.

8. A transfer tail holding device according to claim 7, wherein the notch is V-shaped, the relatively wide top of the V-shaped notch facilitating the receiving of the transfer tail, and the relatively narrow bottom of the V-shaped notch precisely positioning the received transfer tail.

9. A transfer tail holding device according to claim 7, wherein the notch comprises a first notch portion and a second notch portion, the first notch portion being relatively large to facilitate the receiving of the transfer tail, the received transfer tail passing from the first to the second notch portion, the second notch portion being relatively small to precisely hold the transfer tail in a predetermined location.

10. A transfer tail holding device according to claim 7, further comprising a pivotable lever mounted in an unpivoted first position to extend alongside, but not across, the unobstructed path of the notch in the holding member, the lever pivotable to a second position to pass across the notch to effectively narrow the notch to facilitate the capture and holding of the transfer tail.

11. A transfer tail holding device according to claim 7, further comprising a clipper attached to the holding member for severing a transfer tail that passes through the notch.

* * * * *

UNITED STATES PATENT AND TRADEMARK OFFICE

CERTIFICATE OF CORRECTION

PATENT NO. : 5,314,139

DATED : May 24, 1994

INVENTOR(S) : Kiyoaki Mori

It is certified that error appears in the above-identified patent and that said Letters Patent is hereby corrected as shown below:

Column 2, line 61, "Weft a is" should be --Weft *a* is--;

Column 3, line 7, "end b to" should be --end *b* to--;

Column 3, line 9, "end c by" should be --end *c* by--;

Column 3, line 20, "end b and" should be --end *b* and--;

Column 3, line 21, "end c are" should be --end *c* are--;

Column 3, line 34, "weft a occurs" should be --weft *a* occurs--;

Column 4, line 37-38, "end c from" should be --end *c* from--;

Column 4, line 39, "end c during" should be --end *c* during--;

Column 4, line 40, "end c to" should be --end *c* to--; and

Column 6, line 45, "136 Thereafter" should be --136. Thereafter--.

UNITED STATES PATENT AND TRADEMARK OFFICE

CERTIFICATE OF CORRECTION

PATENT NO. : 5,314,139

DATED : May 24, 1994

INVENTOR(S) : Kiyoaki Mori

It is certified that error appears in the above-identified patent and that said Letters Patent is hereby corrected as shown below:

In the Claims:

Column 7, line 9, "means a includes body" should be --means includes a body--;

Column 7, line 15, "to a first notch" should be --of a first notch--;

Column 7, line 21, "claim 1, said" should be --claim 1, wherein said--; and

Column 8, line 19, "facilitate the receiving" should be --facilitate receiving--.

Signed and Sealed this

Twenty-seventh Day of September, 1994

*Attest:*

Bruce Lehman

BRUCE LEHMAN

*Attesting Officer*

*Commissioner of Patents and Trademarks*